US006164557A

United States Patent [19]

Larson

[11] Patent Number: 6,164,557

[45] **Date of Patent: *Dec. 26, 2000**

[54] FLUID TEMPERATURE CONTROL FOR A HEATED FLUID CLEANER WITH MULTIPLE OUTLETS

[75] Inventor: Arden L. Larson, Sioux Falls, S. Dak.

[73] Assignee: Sioux Steam Cleaner Corporation, Beresford, S. Dak.

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,500

[22] Filed: Apr. 30, 1998

[51] Int. Cl.[7] ..... B05B 1/24

[52] U.S. Cl. ..... 239/75; 239/127; 239/135; 239/532; 239/308; 239/310

[58] Field of Search ..... 239/750, 128, 239/135, 139, 127, 532, 302, 305, 310, 308

[56] References Cited

U.S. PATENT DOCUMENTS

| | | | |
|---|---|---|---|
| D. 320,384 | 10/1991 | Jacobs . | |
| 2,295,228 | 9/1942 | Malsbary et al. | 239/75 X |
| 2,345,614 | 4/1944 | Malsbary et al. | 239/75 |
| 2,641,508 | 6/1953 | Stoner et al. | 239/75 |
| 2,987,259 | 6/1961 | Lindquist . | |
| 3,438,580 | 4/1969 | Siebring . | |
| 3,522,909 | 8/1970 | Arant . | |
| 3,556,402 | 1/1971 | Wolking . | |
| 3,684,172 | 8/1972 | Evalds . | |
| 4,034,203 | 7/1977 | Cooper | 239/136 X |
| 4,046,321 | 9/1977 | Hewett . | |
| 4,197,872 | 4/1980 | Parker | 239/318 X |
| 4,263,091 | 4/1981 | King | 239/75 X |
| 4,675,798 | 6/1987 | Jost et al. . | |
| 4,807,445 | 2/1989 | Matsuoka et al. . | |
| 4,979,011 | 12/1990 | Prentice . | |
| 4,993,480 | 2/1991 | Suzuki et al. . | |
| 5,051,121 | 9/1991 | Grundy . | |
| 5,173,224 | 12/1992 | Nakamura et al. . | |
| 5,197,537 | 3/1993 | Chigira et al. . | |
| 5,282,590 | 2/1994 | Zwick . | |
| 5,325,678 | 7/1994 | Borah et al. . | |
| 5,358,541 | 10/1994 | Kindall . | |
| 5,366,154 | 11/1994 | Thompson . | |
| 5,384,526 | 1/1995 | Bennett . | |
| 5,385,106 | 1/1995 | Langshaw . | |
| 5,458,294 | 10/1995 | Zachary et al. | 239/75 X |
| 5,533,671 | 7/1996 | Baer . | |
| 5,551,857 | 9/1996 | Fujioka et al. . | |
| 5,645,217 | 7/1997 | Warren . | |

FOREIGN PATENT DOCUMENTS

| | | |
|---|---|---|
| 2053741 | 2/1981 | United Kingdom . |
| WO 89/01828 | 3/1989 | WIPO . |
| WO 89/12527 | 12/1989 | WIPO . |
| WO 90/02826 | 3/1990 | WIPO . |
| WO 90/14556 | 11/1990 | WIPO . |

*Primary Examiner*—Kevin Weldon
*Assistant Examiner*—Sean P. O'Hanlon
*Attorney, Agent, or Firm*—Kaardal & Associates PC

[57] ABSTRACT

A new fluid temperature control for a heated fluid cleaner with multiple outlets for maintaining the temperature of the discharge fluid when multiple outlets of the heated fluid cleaner are opened. The inventive device includes a fluid reservoir for containing a supply of fluid, at least one pump for suctioning fluid from the fluid reservoir. A heater is also in fluid communication with the pump for heating a flow of fluid received therefrom. The heater preferably comprises a combustible fuel heater and has a fuel conduit fluidly connecting the heater to a fuel reservoir. An outlet conduit is fluidly connected to the heater for receiving heated fluid therefrom. The outlet conduit has a plurality of outlets for discharging fluid therefrom. A heater control device is provided for controlling the temperature of the fluid exiting the heater such that it is maintained at a constant predetermined temperature when more than one outlet is opened.

20 Claims, 3 Drawing Sheets

PRIOR ART

FLUID TEMPERATURE CONTROL FOR A HEATED FLUID CLEANER WITH MULTIPLE OUTLETS

BACKGROUND OF THE INVENTION

1. Field of the Invention

The present invention relates to heated fluid cleaners and more particularly pertains to a new fluid temperature control for a heated fluid cleaner with multiple outlets for maintaining the temperature of the discharge fluid when multiple outlets of the heated fluid cleaner are opened.

2. Description of the Prior Art

The use of heated fluid cleaners is known in the prior art. More specifically, heated fluid cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art heated fluid cleaners include U.S. Pat. No. 5,551,857; U.S. Pat. No. 5,197,537; U.S. Pat. No. 4,807,445; U.S. Pat. No. 5,173,224; U.S. Pat. No. 4,675,798; U.S. Pat. No. 4,979,011; U.S. Pat. No. 3,684,172; U.S. Pat. No. 5,325,678; U.S. Pat. No. 4,993,480; U.S. Pat. No. 5,051,121; U.S. Pat. No. 5,384,526; U.S. Patent Des. 320, 384; PCT Patent No. WO 90/02826 (inventor: Greenberg); PCT Patent No. WO 90/12556 (inventor: Sultan); PCT Patent No. WO 89/12527 (inventor: Chigira); EPO Patent 0 161 891 A2 (inventor: Hughes); and EPO Patent 0 149 928 A1 (inventor: Chauvin).

While these devices fulfill their respective, particular objectives and requirements, the aforementioned patents do not disclose a new fluid temperature control for a heated fluid cleaner with multiple outlets. In prior art heated fluid cleaners with multiple outlets, the temperature of the fluid discharged drops when additional outlets are opened such that a constant temperature is not maintained. With reference to FIG. 3, point a represents the temperature of the discharge fluid when one outlet is opened. As depicted by point b, when multiple outlets are opened to discharge fluid the temperature of the discharge fluid drops because the increase in rate of fluid flow through the heater when the additional outlets are first opened is not matched right away by an corresponding increase in the amount of heat provided by the heater. This causes the fluctuation in the temperature of discharge fluid when multiple outlets are opened.

In these respects, the fluid temperature control for a heated fluid cleaner with multiple outlets according to the present invention substantially departs from the conventional concepts and designs of the prior art, and in so doing provides an apparatus primarily developed for the purpose of maintaining the temperature of the discharge fluid when multiple outlets of the heated fluid cleaner are opened.

SUMMARY OF THE INVENTION

In view of the foregoing disadvantages inherent in the known types of heated fluid cleaners now present in the prior art, the present invention provides a new fluid temperature control for a heated fluid cleaner with multiple outlets construction wherein the same can be utilized for maintaining the temperature of the discharge fluid when multiple outlets of the heated fluid cleaner are opened.

The general purpose of the present invention, which will be described subsequently in greater detail, is to provide a new fluid temperature control for a heated fluid cleaner with multiple outlets apparatus and method which has many of the advantages of the heated fluid cleaners mentioned heretofore and many novel features that result in a new fluid temperature control for a heated fluid cleaner with multiple outlets which is not anticipated, rendered obvious, suggested, or even implied by any of the prior art heated fluid cleaners, either alone or in any combination thereof.

To attain this, the present invention generally comprises a fluid reservoir for containing a supply of fluid, and at least one pump for suctioning fluid from the fluid reservoir. A heater is also in fluid communication with the pump for heating a flow of fluid received therefrom. The heater preferably comprises a combustible fuel heater and has a fuel conduit fluidly connecting the heater to a fuel reservoir. An outlet conduit is fluidly connected to the heater for receiving heated fluid therefrom. The outlet conduit has a plurality of outlets for discharging fluid therefrom. A heater control device is provided for controlling the temperature of the fluid exiting the heater such that it is maintained at a constant predetermined temperature when more than one outlet is opened. The heater control device includes a thermocouple for generating a temperature signal commensurate with a temperature of the fluid exiting the heater, a controller connected to the thermocouple for generating a control signal corresponding to a temperature represented by the temperature signal, and a fuel supply valve is located in the fuel conduit for selectively opening and closing the fuel conduit to permit selective passage of fuel from the fuel reservoir to the heater. The fuel supply valve is connected to the controller for governing an amount of fuel supplied to the heater through the fuel conduit in accordance with the control signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fluid temperature control for a heated fluid cleaner with multiple outlets apparatus and method which has many of the advantages of the heated fluid cleaners mentioned heretofore and many novel features that result in a new fluid temperature control for a heated fluid cleaner with multiple outlets which is not anticipated, rendered obvious, suggested, or even implied by any of the prior art heated fluid cleaners, either alone or in any combination thereof.

It is another object of the present invention to provide a new fluid temperature control for a heated fluid cleaner with multiple outlets which may be easily and efficiently manufactured and marketed.

It is a further object of the present invention to provide a new fluid temperature control for a heated fluid cleaner with multiple outlets which is of a durable and reliable construction.

An even further object of the present invention is to provide a new fluid temperature control for a heated fluid cleaner with multiple outlets which is susceptible of a low cost of manufacture with regard to both materials and labor, and which accordingly is then susceptible of low prices of sale to the consuming public, thereby making such fluid temperature control for a heated fluid cleaner with multiple outlets economically available to the buying public.

Still yet another object of the present invention is to provide a new fluid temperature control for a heated fluid cleaner with multiple outlets which provides in the apparatuses and methods of the prior art some of the advantages thereof, while simultaneously overcoming some of the disadvantages normally associated therewith.

Still another object of the present invention is to provide a new fluid temperature control for a heated fluid cleaner with multiple outlets for maintaining the temperature of the discharge fluid when multiple outlets of the heated fluid cleaner are opened.

Yet another object of the present invention is to provide a new fluid temperature control for a heated fluid cleaner with multiple outlets which includes a fluid reservoir for containing a supply of fluid, and at least one pump for suctioning fluid from the fluid reservoir. A heater is also in fluid communication with the pump for heating a flow of fluid received therefrom. The heater preferably comprises a combustible fuel heater and has a fuel conduit fluidly connecting the heater to a fuel reservoir. An outlet conduit is fluidly connected to the heater for receiving heated fluid therefrom. The outlet conduit has a plurality of outlets for discharging fluid therefrom. A heater control device is provided for controlling the temperature of the fluid exiting the heater such that it is maintained at a constant predetermined temperature when more than one outlet is opened.

Still yet another object of the present invention is to provide a new fluid temperature control for a heated fluid cleaner with multiple outlets that allows a user to maintain a relative constant temperature of the discharged fluid when multiple fluid outlets are opened.

Even still another object of the present invention is to provide a new fluid temperature control for a heated fluid cleaner with multiple outlets that allows generally constant temperature control of heated fluid cleaners user combustible fuel fired heaters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
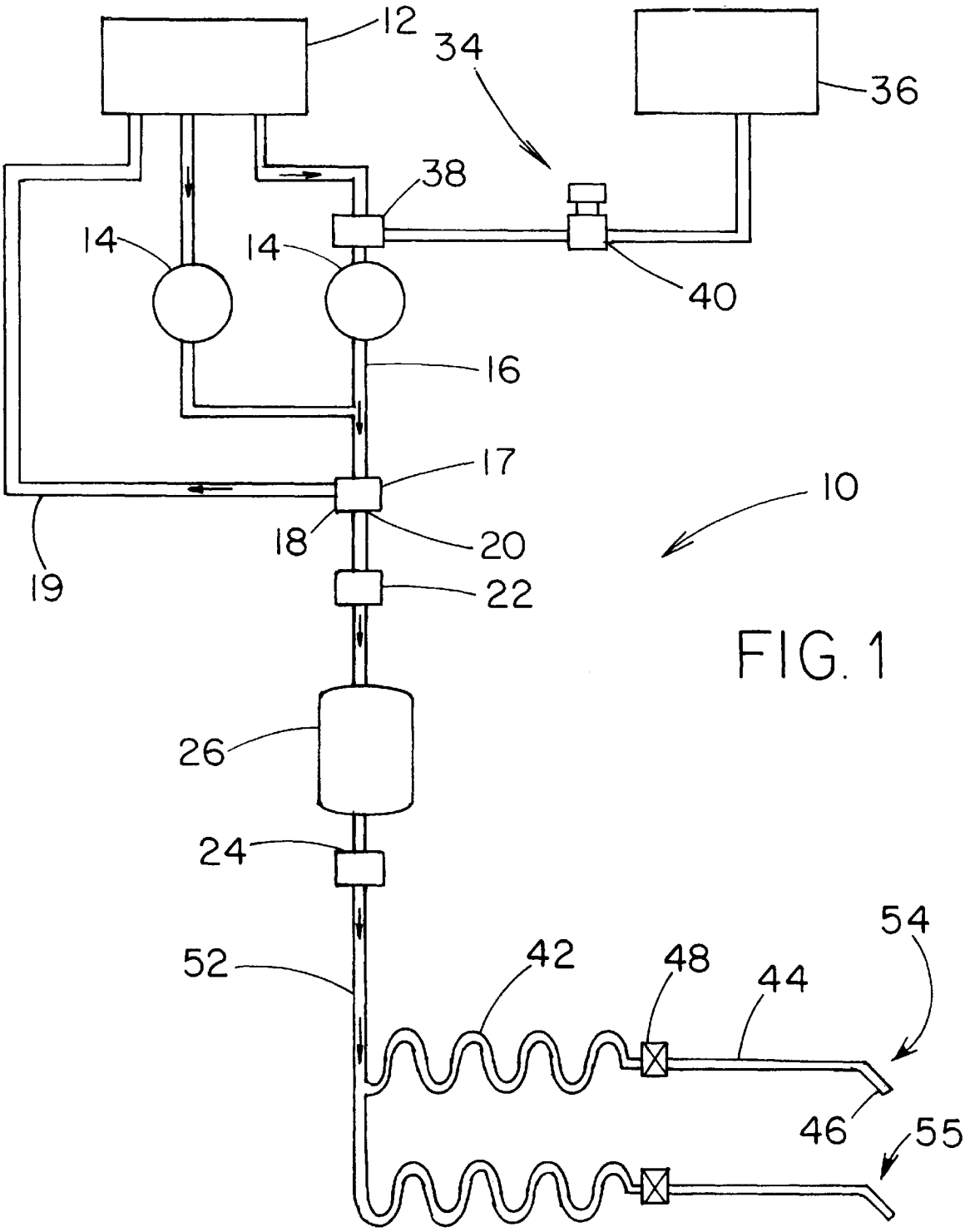
FIG. 1 is a schematic view of a new fluid temperature control for a heated fluid cleaner with multiple outlets according to the present invention.
Figure 2:
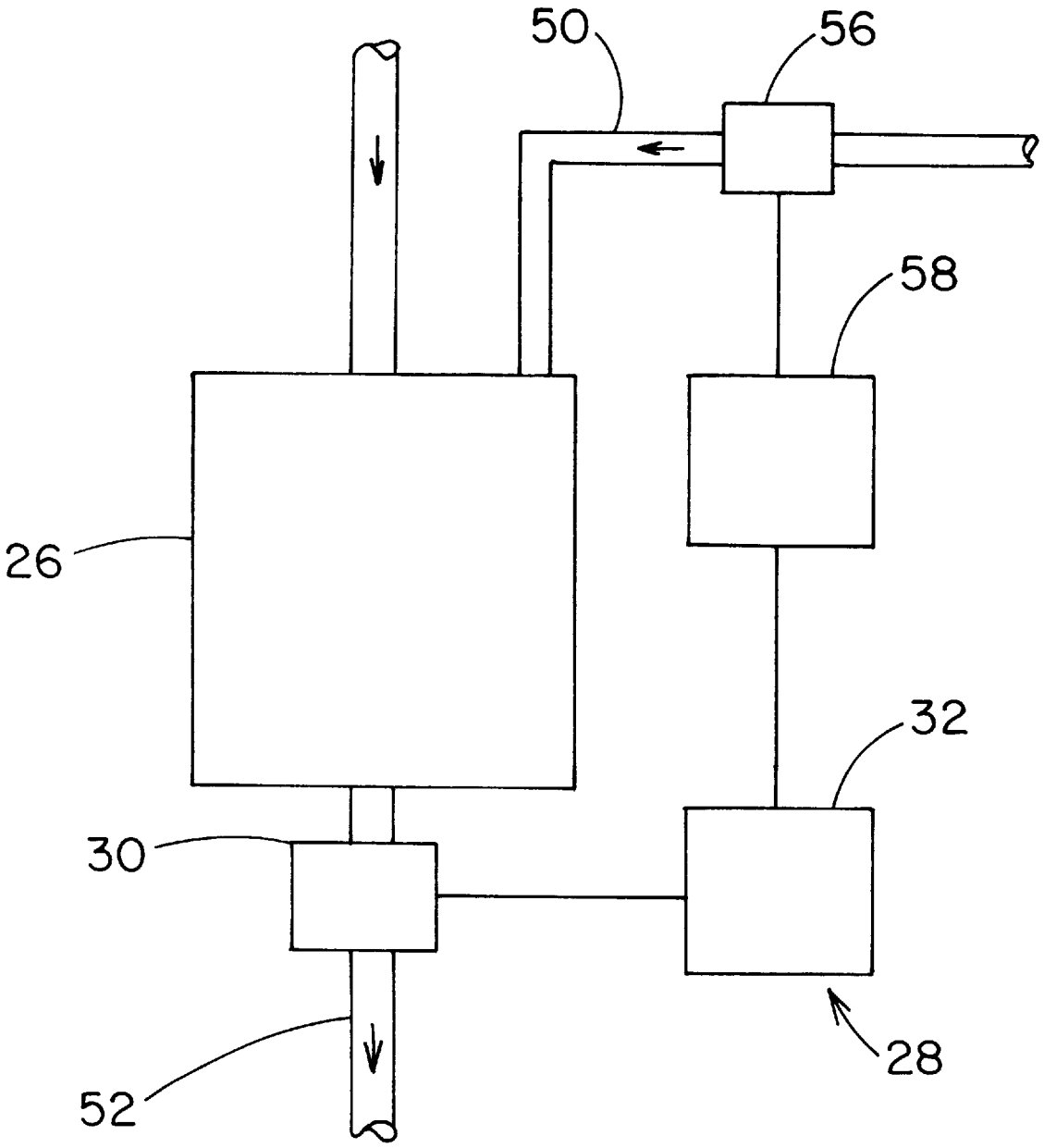
FIG. 2 is a schematic view of the heater control device of the present invention.
Figure 3:
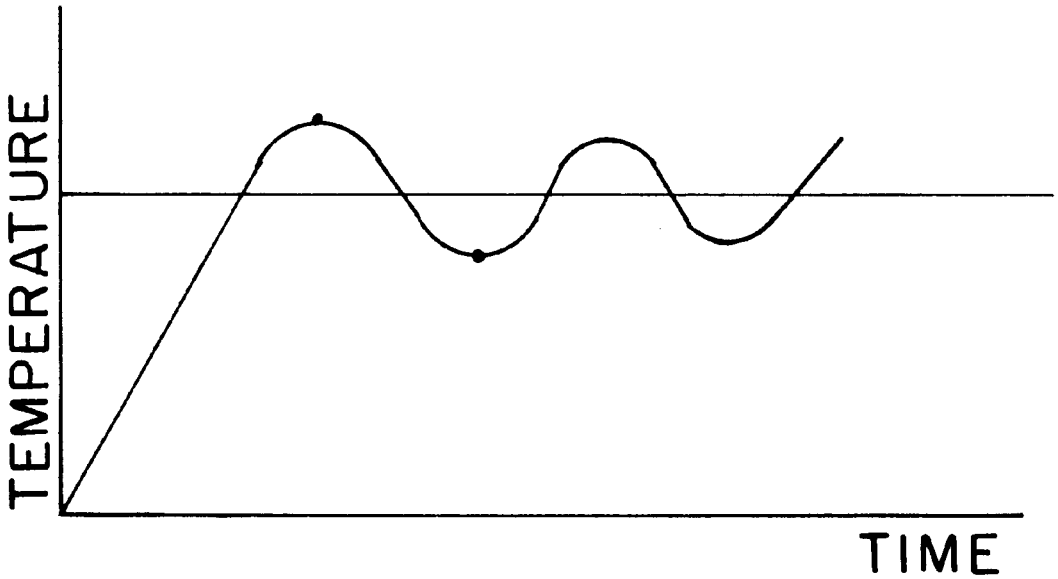
FIG. 3 is a pair of schematic graphs illustrating the fluctuation in temperature of the prior art heated fluid cleaners and the present invention's constant temperature of the discharge fluid when multiple outlets are opened to release discharge fluid.
Figure 3:
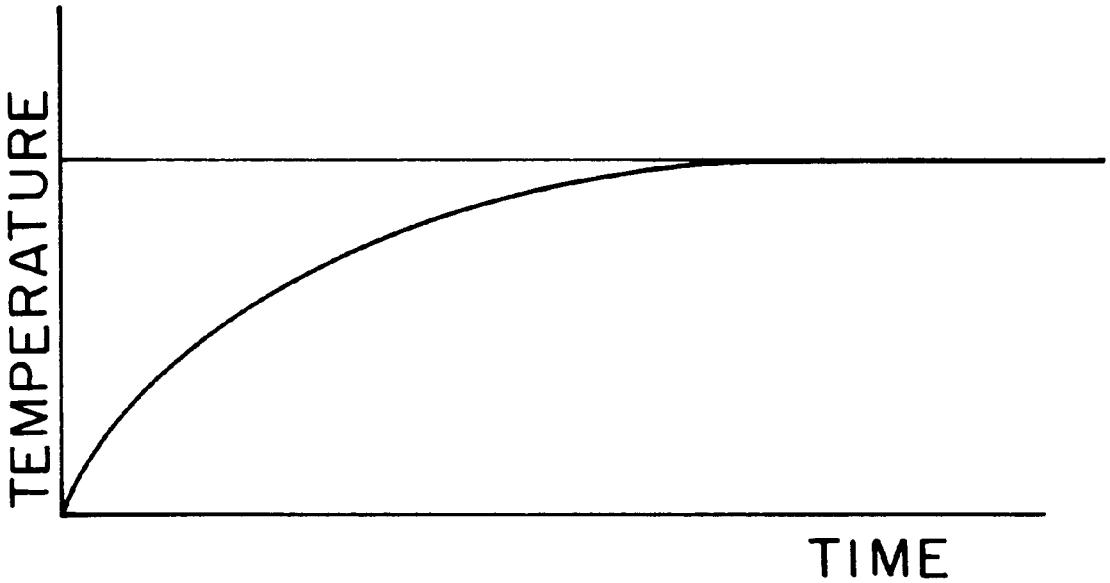

With reference now to the drawings, and in particular to FIGS. 1 through 3 thereof, a new fluid temperature control for a heated fluid cleaner with multiple outlets embodying the principles and concepts of the present invention and generally designated by the reference numeral 10 will be described.

As best illustrated in FIGS. 1 through 3, the fluid temperature control for a heated fluid cleaner with multiple outlets 10 generally comprises a fluid reservoir for containing a supply of fluid, at least one pump for suctioning fluid from the fluid reservoir. A heater is also in fluid communication with the pump for heating a flow of fluid received therefrom. The heater preferably comprises a combustible fuel heater and has a fuel conduit fluidly connecting the heater to a fuel reservoir. An outlet conduit is fluidly connected to the heater for receiving heated fluid therefrom. The outlet conduit 52 has a plurality of outlets 54, 55 for discharging fluid therefrom. A heater control device 28 is provided for controlling the temperature of the fluid exiting the heater such that it is maintained at a constant predetermined temperature when more than one outlet 54, 55 is opened.

In closer detail, the heated fluid cleaner with temperature control permits the discharge of a generally constant temperature when multiple fluid outlets on the cleaner are opened. As illustrated in FIG. 1, the heated fluid cleaner 10 includes a fluid reservoir 12 for containing a supply of fluid. A pair of pumps 14 each have an inlet conduit 16 connected to the fluid reservoir. When actuated, the pumps 14 suction fluid from the fluid reservoir 12 and expelling the same from an output thereof. Such actuation is preferably effected by way of a control panel.

An unloader valve 17 has an input connected to the outputs of the pumps. A first output 18 of the unloader valve is connected to the fluid reservoir 12 via a bypass conduit 19. The unloader valve 17 also has a second output 20. In operation, the unloader valve 17 has a first mode of operation during normal use for passing the fluid from the input conduit 16 to the second output thereof. While in a second mode of operation, the unloader valve 17 directs fluid from the input conduit 16 to the first output whenever back flow fluid is received from the second output. As such, the unloader valve 17 acts as a one way valve that redirects back flow fluid.

Connected to the second output 20 of the unloader valve 17 is a flow switch 22. The flow switch 22 is a normally open switch which generates an activation signal only when a flow rate of fluid from the unloader valve 17 is at least a minimum amount. Associated therewith is a temperature switch 24 which is also connected to the second output 20 of the unloader valve 17. The temperature switch 24 is a normally open switch which generates the activation signal only when a temperature of the fluid remains below a maximum amount.

As shown in FIG. 1, an additive injection assembly 34 may also be provided and includes an additive tank 36 for containing a predetermined amount of cleaning solution. For injecting the cleaning solution into the fluid, a siphon injector 38 is connected between the additive tank 36 and the inlet conduit of one of the pumps. By this unique point of injection, the cleaning solution is not subjected to the high pressures present in the remaining system. A solenoid 40 is situated between the additive tank and the siphon injector. The solenoid is further connected to the flow switch 22 and an unillustrated solenoid activation switch. In use, the solenoid allows the flow of cleaning solution to the siphon injector only upon the actuation of the solenoid activation switch and the receipt of the activation signal from the flow switch 22. As such, no cleaning solution is injected when the system lacks a flow of fluid.

A heater 26 is in communication with the second output of the unloader valve 17 and is positioned between the flow switch 22 and the temperature switch 24. Preferably, the heater 26 comprises a combustible fuel heater 26 and has a fuel conduit 50 fluidly connecting the heater 26 to a fuel reservoir. The fuel conduit 50 is designed for passing fuel from the fuel reservoir to the heater 26. It should be noted that the heater 26 is connected to the flow switch 22 and the temperature switch 24 for heating fluid received from the unloader valve 17 only upon the receipt of the activation signal from both the flow switch 22 and the temperature switch 24. As such, whenever the temperature and flow rate of the fluid deviates undesirably, the heater 26 deactuates and re-actuates once the conditions are again favorable.

An outlet conduit 52 is fluidly connected to the heater 26 for receiving heated fluid therefrom. The outlet conduit 52 has a plurality of outlets 54, 55 for discharging fluid therefrom. Preferably, each of the outlets 54, 55 comprises a spray gun 44 and a length of flexible hose 42 located adjacent the spray gun 44. Each of the spray guns 44 ideally includes a wash tip 46 for controlling the flow of fluid from the gun 44 and a shut off valve 48 for selectively precluding the flow of fluid from the gun.

With reference to FIG. 2, a heater control device 28 is shown to include a thermocouple 30 mounted on an outlet of the heater 26. The thermocouple is adapted for generating a temperature signal commensurate with a temperature of the fluid exiting the heater 26. Connected to the thermocouple is a PID controller 32 for generating a 4–20 mA control signal corresponding to a temperature represented by the temperature signal.

The heater control device 28 also includes a fuel supply valve 56 located in the fuel conduit 50 for selectively opening and closing the fuel conduit 50 to permit selective passage of fuel from the fuel reservoir to the heater 26. In an illustrative ideal embodiment, the fuel supply valve 56 is a type of butterfly gas/air valve for providing modulating control of fuel gases and air. The heater control device 28 further includes a valve actuator 58 for controlling the opening and closing of the fuel supply valve 56. The valve actuator 58 is designed for controlling the amount of fuel passing through the fuel supply valve 56 by controlling the amount (that is, the degree) the fuel supply valve 56 is open. In the ideal illustrative embodiment, the valve actuator 58 comprises a reversing, proportional motor used to drive burner firing rate valves such as the type sold under the registered trade name Modutrol, in particular Flame Safeguard Modutrol IV Motors, which use a linkage to connect it to the fuel supply valve 56. The valve actuator 58 is connected to the PID controller 32 for governing an amount of fuel supplied to the heater 26 through the fuel conduit 50 in accordance with the control signal. By the foregoing structure, the temperature of the fluid exiting the heater 26 transitions smoothly to a constant predetermined temperature. Note FIG. 3. It should be understood that the PID controller 32 detects a rate of temperature change of the fluid for increasing and decreasing the rate of fuel flow to the heater 26 by way of the fuel supply valve 56 and the valve actuator 58 such that the temperature does not overshoot and/or undershoot the desired temperature when multiple outlets 54, 55 are opened to discharge fluid, as is common in the prior art. Note FIG. 3. In the preferred embodiment, the desired temperature is manually selected with an unillustrated dial connected to the PID controller. Further, the PID may be programmable to perform an auto-tuning procedure for anticipating the heating response for a given condition.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated fluid cleaner with temperature control, comprising:

a fluid reservoir for containing a supply of fluid;

at least one pump for suctioning fluid from said fluid reservoir, said pump having an output;

a heater in communication with said pump for heating a flow of fluid received therefrom;

wherein said heater comprises a combustible fuel heater and has a fuel conduit fluidly connecting said heater to a fuel reservoir, said fuel conduit being for passing fuel from said fuel reservoir to said heater;

an outlet conduit being fluidly connected to said heater for receiving heated fluid therefrom;

said outlet conduit having a plurality of outlets for discharging fluid therefrom;

a heater control device for controlling the temperature of the fluid exiting said heater such that it is maintained at a constant predetermined temperature; and an unloader valve having an input connected to said output of said pump, said unloader valve having a first output connected to said fluid reservoir by a bypass conduit, said unloader valve having a second output in fluid communication with said heater, said unloader valve having a first mode of operation during normal use for passing the fluid from the input of the unloader valve to said second output of the unloader valve, and a second mode of operation for directing fluid from the input of said unloader valve to the first output of said unloader valve only when back flow fluid is received from the second output of said unloader valve.

2. The heated fluid cleaner with temperature control of claim 1, wherein said heater control device includes a thermocouple for generating a temperature signal commensurate with a temperature of the fluid exiting said heater, a controller connected to said thermocouple for generating a control signal corresponding to a temperature represented by the temperature signal, and a fuel supply valve being located in said fuel conduit for selectively opening and closing said fuel conduit to permit selective passage of fuel from said fuel reservoir to said heater, said fuel supply valve being connected to said controller for governing an amount of fuel supplied to said heater through said fuel conduit in accordance with the control signal.

3. The heated fluid cleaner with temperature control of claim 1, further including an additive injection assembly having an additive tank for containing a predetermined amount of cleaning solution and a solution injector for injecting the cleaning solution into the flow of fluid upon the receipt thereof.

4. The heated fluid cleaner with temperature control of claim 3, further including a solenoid situated between said additive tank and said solution injector and further connected to a solenoid activation switch for allowing the flow of cleaning solution to said solution injector only upon the depression of the switch.

5. The heated fluid cleaner with temperature control of claim 4, wherein the solenoid allows the flow of cleaning solution to the solution injector only when the flow of fluid within the cleaner is at least a predetermined amount.

6. The heated fluid cleaner with temperature control of claim 1, further including a second pump, the output of said second pump being in fluid communication with the input of said unloader valve such that two pumps are fluidly connected in parallel between said reservoir and said unloader valve.

7. The heated fluid cleaner with temperature control of claim 1, wherein the heater only heats the fluid when the flow of the fluid is at least a minimum amount.

8. The heated fluid cleaner with temperature control of claim 1, wherein the heater only heats the fluid when the temperature of the fluid is less than a maximum amount.

9. The heated fluid cleaner with temperature control of claim 1, further including wherein each of said outlets includes a spray gun for directing flow of fluid from said outlet.

10. The heated fluid cleaner with temperature control of claim 1, wherein the fluid exiting the heater is heated such that it transitions smoothly to the constant predetermined temperature.

11. A heated fluid cleaner with temperature control, comprising:

a fluid reservoir for containing a supply of fluid;

a pair of pumps each having an inlet conduit connected to said fluid reservoir for suctioning fluid therefrom and expelling the same from an output thereof when actuated, said pumps being operable in parallel to each other;

an unloader valve having an input connected to said outputs of the pumps, a first output connected to said fluid reservoir via a bypass conduit, and a second output, said unloader valve having a first mode of operation during normal use for passing the fluid from said input thereof to said second output thereof and a second mode of operation for directing fluid from said input conduit to said first output only when back flow fluid is received from said second output;

an additive injection assembly including an additive tank for containing a predetermined amount of cleaning solution a siphon injector connected between said additive tank and said inlet conduit of one of said pumps for injecting the cleaning solution into the fluid upon the receipt thereof;

a flow switch connected to the second output of said unloader valve and adapted to generate an activation signal only when a flow rate of fluid from said unloader valve is at least a minimum amount;

a solenoid situated between said additive tank and said siphon injector and further connected to said flow switch and a solenoid activation switch for allowing the flow of cleaning solution to said siphon injector only upon activation of said solenoid activation switch and the receipt of the activation signal from said flow switch:

a temperature switch connected to said second output of said unloader valve and adapted to generate the activation signal only when a temperature of the fluid remains below a maximum amount;

a heater in communication with said second output of said unloader valve and positioned between said flow switch and said temperature switch, said heater connected to said flow switch and said temperature switch for heating fluid received from said unloader valve only upon the receipt of the activation signal from both said flow switch and said temperature switch:

wherein said heater comprises a combustible fuel heater and has a fuel conduit fluidly connecting said heater to a fuel reservoir, said fuel conduit being for passing fuel from said fuel reservoir to said heater;

an outlet conduit being fluidly connected to said heater for receiving heated fluid therefrom;

said outlet conduit having a plurality of outlets for discharging fluid therefrom, wherein each of said outlets includes a spray gun;

a heater control device including a thermocouple mounted on an outlet of said heater for generating a temperature signal commensurate with a temperature of the fluid exiting said heater, a PID controller connected to said thermocouple for generating a control signal corresponding to a temperature represented by the temperature signal, a fuel supply valve being located in said fuel conduit for selectively opening and closing said fuel conduit to permit selective passage of fuel from said fuel reservoir to said heater, said fuel supply valve comprising a butterfly gas/air valve, a valve actuator for controlling the opening and closing of said fuel supply valve for controlling the amount of said fuel passing through said fuel supply valve, said valve actuator comprising a reversing proportional motor connected by a linkage to said fuel supply valve, said valve actuator being connected to said PID controller for governing an amount of fuel supplied to said heater through said fuel conduit in accordance with the control signal, wherein the temperature of the fluid exiting said heater transitions smoothly to a constant predetermined temperature.

12. The heated fluid cleaner with temperature control of claim 1, wherein said heater control device comprises a thermocouple mounted on an outlet of said heater for generating a temperature signal commensurate with a temperature of the fluid exiting said heater, a PID controller connected to said thermocouple for generating a control signal corresponding to a temperature represented by the temperature signal, a fuel supply valve being located in said fuel conduit for selectively opening and closing said fuel conduit to permit selective passage of fuel from said fuel reservoir to said heater, said fuel supply valve comprising a butterfly gas/air valve, a valve actuator for controlling the opening and closing of said fuel supply valve for controlling the amount of said fuel passing through said fuel supply valve, said valve actuator comprising a reversing proportional motor connected by a linkage to said fuel supply valve, said valve actuator being connected to said PID controller for governing an amount of fuel supplied to said heater through said fuel conduit in accordance with the control signal, wherein the temperature of the fluid exiting said heater transitions smoothly to a constant predetermined temperature.

13. The heated fluid cleaner with temperature control of claim 1, wherein said unloader valve directs a back flow of said fluid reservoir.

14. A heated fluid cleaner with temperature control, comprising:

at least one pump for creating a fluid flow between an inlet conduit of said pump and an output of said pump;

a heater in communication with said pump for heating the fluid flow received from said pump;

wherein said heater comprises a combustible fuel heater and has a fuel conduit for fluidly connecting said heater to a fuel source;

an outlet conduit being fluidly connected to said heater for receiving heated fluid therefrom;

said outlet conduit having a plurality of outlets for discharging fluid therefrom;

a heater control device for controlling the temperature of the fluid exiting said heater such that it is maintained at a predetermined temperature; and an unloader valve having an input connected to said output of said pump, said unloader valve having a first output in communication with the inlet conduit of said pump through a bypass conduit, said unloader valve having a second output in fluid communication with said heater, said unloader valve having a first mode of operation during normal use for passing the fluid from the input of the unloader valve to said second output of the unloader valve, and a second mode of operation for directing fluid from the input of said unloader valve to the first output of said unloader valve only when back flow fluid is received from the second output of said unloader valve.

15. The heated fluid cleaner with temperature control of claim 14, wherein said heater control device includes a thermocouple for generating a temperature signal commensurate with a temperature of the fluid exiting said heater, a controller connected to said thermocouple for generating a control signal corresponding to a temperature represented by the temperature signal, and a fuel supply valve being located in said fuel conduit for selectively opening and closing said fuel conduit to permit selective passage of fuel from said fuel source to said heater, said fuel supply valve being connected to said controller for governing an amount of fuel supplied to said heater through said fuel conduit in accordance with the control signal.

16. The heated fluid cleaner with temperature control of claim 14, further including a second pump, the output of said second pump being in fluid communication with the input of said unloader valve such that two pumps are fluidly connected in parallel to said unloader valve.

17. The heated fluid cleaner with temperature control of claim 14, wherein the heater only heats the fluid when the flow of the fluid is at least a minimum amount.

18. The heated fluid cleaner with temperature control of claim 14, wherein the heater only heats the fluid when the temperature of the fluid is less than a maximum amount.

19. The heated fluid cleaner with temperature control of claim 14, wherein said heater control device comprises a thermocouple mounted on an outlet of said heater for generating a temperature signal commensurate with a temperature of the fluid exiting said heater, a PID controller connected to said thermocouple for generating a control signal corresponding to a temperature represented by the temperature signal, a fuel supply valve being located in said fuel conduit for selectively opening and closing said fuel conduit to permit selective passage of fuel from said fuel source to said heater, said fuel supply valve comprising a gas/air valve, a valve actuator for controlling the opening and closing of said fuel supply valve for controlling the amount of said fuel passing through said fuel supply valve, said valve actuator comprising a reversing proportional motor connected by a linkage to said fuel supply valve, said valve actuator being connected to said PID controller for governing an amount of fuel supplied to said heater through said fuel conduit in accordance with the control signal, wherein the temperature of the fluid exiting said heater transitions smoothly to a constant predetermined temperature.

20. The heated fluid cleaner with temperature control of claim 14, wherein said unloader valve directs a back flow fluid to a fluid reservoir in communication with said bypass conduit.

* * * * *